US005239802A

United States Patent [19]

Robinson

[11] Patent Number: 5,239,802

[45] Date of Patent: Aug. 31, 1993

[54] ADHESIVE ARRANGEMENT FOR SHINGLES AND THE LIKE

[75] Inventor: Norman M. Robinson, Coatesville, Pa.

[73] Assignee: CertainTeed Corporation, Valley Forge, Pa.

[21] Appl. No.: 924,430

[22] Filed: Jul. 31, 1992

Related U.S. Application Data

[63] Continuation of Ser. No. 566,674, Aug. 13, 1990, abandoned.

[51] Int. Cl.[5] ..... E04D 1/00

[52] U.S. Cl. ..... 52/518; 52/553

[58] Field of Search ..... 52/420, 518, 520, 540, 52/543, 528, 553, 541, 551, 552, 555

[56] References Cited

U.S. PATENT DOCUMENTS 2,421,892 6/1947 Kirschbraun ..... 52/420
2,863,405 12/1958 Leibrook et al. .
3,660,955 5/1972 Simon ..... 52/420
4,856,251 8/1989 Buck ..... 52/553

OTHER PUBLICATIONS

1982 Sweet's Catalog File, Products for Light Residential Construction, 7.7/Jo, p. 2, shingle and p. 4, The Woodlands Roof shingles.

*Primary Examiner*—Carl D. Friedman
*Assistant Examiner*—Creighton Smith
*Attorney, Agent, or Firm*—Paul and Paul

[57] ABSTRACT

A shingle or other roof covering is provided, comprising a tab portion and a butt portion. The shingle surface is provided with a band zone, in which adhesive zones are applied. The band zones run the entire width of a shingle, and are preferably located either on the underside surface of the tab portions, or on the top surface of butt portions The adhesive pattern is so that shingle lifting due to wind is resisted, but so that moisture can escape between overlapped shingles when the adhesive secures them together.

9 Claims, 2 Drawing Sheets

ADHESIVE ARRANGEMENT FOR SHINGLES AND THE LIKE

This application is a continuation, of application Ser. No. 566,674, filed Aug. 13, 1990 now abandoned.

BACKGROUND OF THE INVENTION

This invention relates generally to asphaltic roofing covering, and more particularly to a shingle provided with an adhesive component for securing portions of overlapping or underlying shingles thereon and the process specifically adapted to apply such an adhesive component.

In the present state of shingle manufacturing, adhesive is provided at a few points on the underside surface of shingle tab portions. Heat from the environment, more particularly from the sun, activates the adhesive to allow bonding of shingle surfaces. Prior art type shingles provide adhesive in the form of spaced apart rectangular bands, the rectangular designations being an incident of the manner of sealant application.

It is an object of this invention to provide a shingle with an adhesive component which will secure shingle portions to one another and provide improved drainage of entrained rain water and resistance to wind blow-off, and resistance to shingle distortion caused by internal stresses.

It is a further object of the present invention to provide a shingle with an adhesive configuration which will realize increased effective linear coverage of sealant across the width of a shingle using only partial material coverage.

It is another object of the invention to provide a process for applying sealant or adhesive material to a shingle surface whereby geometries of adhesive bands can be maintained.

Another object of the present invention is to provide a roof system comprising shingles having novel adhesive construction.

Other objects and advantages of the present invention will be readily apparent to those skilled in the art from a reading of the following brief description of the drawings, detailed description of the preferred embodiment and the appended claims.

SUMMARY OF THE INVENTION

In accordance with the principles of the present invention, a roofing shingle is provided with a novel adhesive band component. The adhesive bands are located either preferably on the underside surface of shingle tabs or, alternatively on the top surface of shingle butt portions, and provide a means for securing overlapping shingles to each other. The adhesive components of the shingle surface is preferably activated by environmental heating supplied by the sun, so that adhesion of overlapping shingle tab and butt surfaces is accomplished. The adhesive is provided in band configurations wherein at least one band has an angular edge or the equivalent, thereby creating a generally sloped space between adhesive bands. Such configurations provide improved shingle stability and holding properties due to effective improved drainage of entrained rain water and greater resistance to wind blow-off and greater resistance to shingle distortion caused by internal stresses. The adhesive bands may be aligned such that there is a zone of adhesive spanning horizontally across a shingle surface which provides increased effective linear sealant coverage. Wind blow-off is greatly minimized because, especially in the instance of full effective linear coverage, the adhesive acts to provide a barrier to exclude wind and other elements from passing into the space between shingle layers Shingle distortion, such as lifted corners, etc. is also greatly minimized. The invention also related to the process whereby adhesive is applied to a shingle surface in a specific geometrical patterns by utilizing an applicator wheel specifically adapted to handle adhesive surface tensions and viscosities in order to maintain the desired configuration. The shingles provided may be overlapped to form a roof system of superior strength and durability resulting from the operation of the novel adhesive configuration and patterns.

BRIEF DESCRIPTION OF THE DRAWING FIGURES

Figure 5:
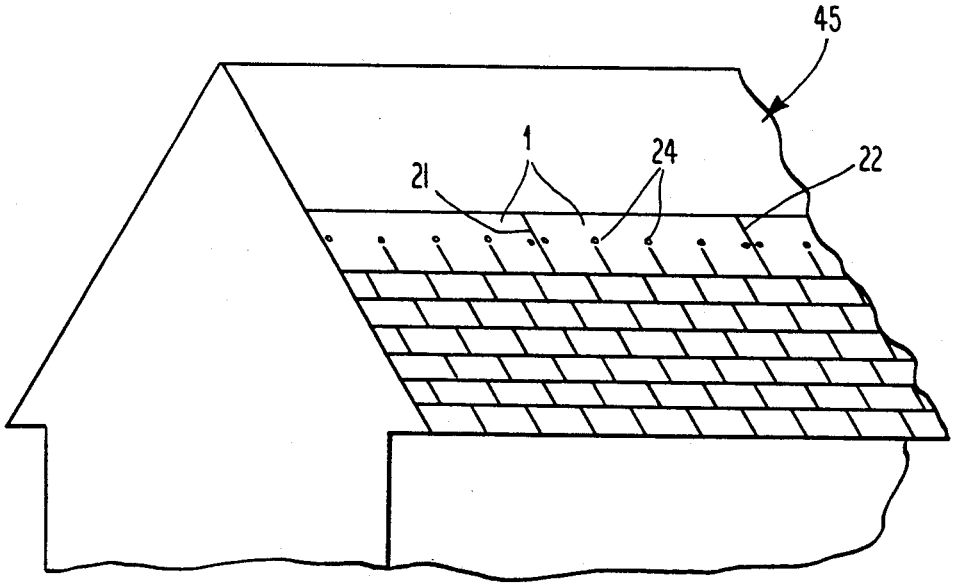

FIG. 5 discloses a roof system comprising shingles of the present invention.

DETAILED DESCRIPTION OF THE PREFERRED EMBODIMENT

Figure 1:
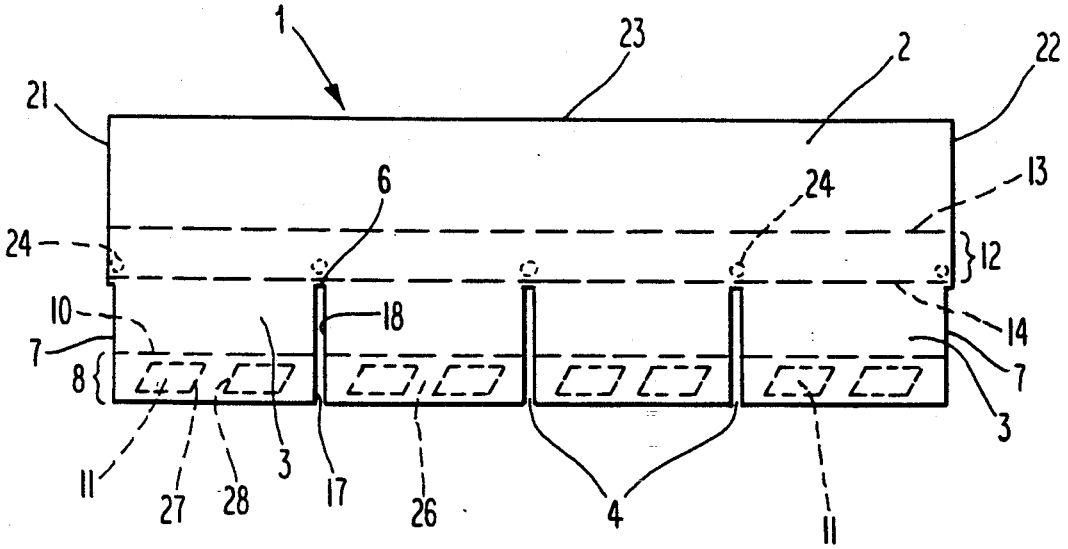
FIG. 1 is a top plan view of a shingle of this invention.

Referring now to the drawings in detail, reference is first made to FIG. 1, which illustrates a roofing shingle 1 which is generally constructed from asphalt or other suitable roofing material.

The roofing shingle 1 comprises a butt portion 2 and tab portions 3. Tab portions are separated from one another by intervening slots 4 which are defined by a pair of shingle tab side edges 17 and 18. The slots extend starting at the point of intersection 20 of a shingle tab bottom edge 5 and a shingle tab side edge 17 or 18, and end at a point 6 where the tab portion joins the butt portion, so that the end of the slot is preferably defined by a lower edge 6 of the butt portion.

Shingle butt portions are defined laterally by a pair of side edges 21 and 22, and by the upper edge 23 of the shingle 1 and the upper edge as shown as an imaginary line 14, of the tab portion. Shingle butt portions of successive shingles may be placed laterally adjacent to one another, such that a shingle butt edge 22 of one shingle is in contact with the butt edge 21 of another shingle. Successive shingles may be placed next to each another in a similar manner with butt edges 21 and 22 adjoining other shingle butt edges in the normal practice of making a shingled roof as shown in FIG. 5. The tab portions 3 have side edges 7 of a shingle 1. The side edges 7 will preferably be recessed as shown from the shingle butt edges 21 and 22 such that when the butt edges 21 and 22 of two shingles are in lateral contact with each other, the shingle tab edges 7 will function as one of the shingle tab side edges 17 or 18 to form a slot 4, in conventional manner.

A shingle 1 is provided with a band zone 8 having an area spanning horizontally across the bottom of the shingle tab portions, beneath imaginary line 10. The band zone is located on the underside of the shingle tab portions, as shown in dotted lines in FIG. 1 and comprises adhesive material. Alternatively or additionally, a band zone 12 may be located on the top surface of a shingle butt portion, on the granules thereof, preferably near to the end adjoining the tab portion as represented in FIG. 1 as the area between a pair of imaginary lines 13 and 14.

Adhesive zones 11 are provided on the underside surface of shingle tabs 3 within the band zone 8, as seen in FIG. 1.

The adhesive zones 11 are provided with structural geometries conducive to promoting high performance in the shingle art FIG. 1 shows an arrangement of adhesive zone configurations 11 in band 8 represented by parallelogram shapes having generally angular parallel side edges 27 and 28, separated by a space 26 therebetween. The shingles may be secured to a roof or mounting surface by nailing. Nailing zones located by imaginary lines 24 are provided on the butt portion 2 in the areas above the termination point 6 of the slots 4 defining shingle tabs.

Figure 2:
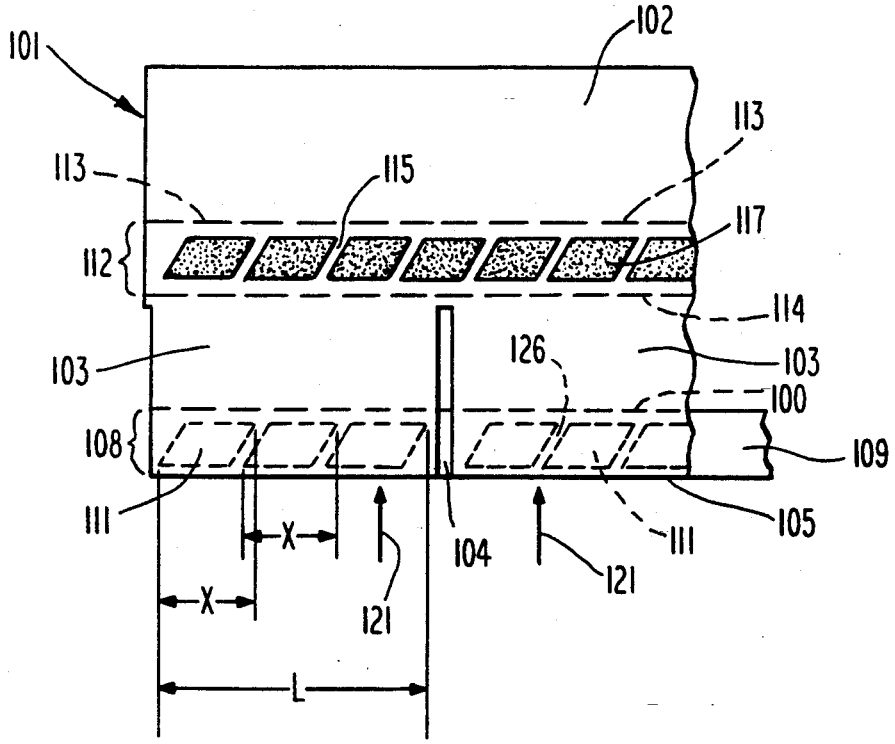
FIG. 2 is an enlarged fragmentary plan view of an alternative shingle construction.

With particular reference to FIG. 2, it will be seen that a shingle 101 is provided, having a butt portion 102 and a plurality of tab portions 103. Above the slots 104 that form the spaces between adjacent tab portions 103, it will be seen that an imaginary line 114 appears, and thereabove, another imaginary line 113, defining therebetween a band 112 having a plurality of adhesive zones 117 on an upper surface of the shingle 101, as shown. In addition thereto, there is provided a band 108 between the lower edge 105 of tab portions and imaginary line 100, as shown, and within which band there are provided a plurality of adhesive zones 111, shown in dotted lines, indicating their presence on the lower surface of the shingle 101. The adhesive zones 111, like those 11 of the embodiment of FIG. 1, are of parallelogram configuration.

The adhesive zones 111 and 117 are each spaced from adjacent zones within their respective bands 108 and 112. It will be seen that the horizontal dimension "X" as measured from one end of a given adhesive zone 111 to the opposite end of that zone 111, together with the similar dimension "X" for the other adhesive zones 111 in the same band, that comprise the band portion of FIG. 2 that is defined by the measurement "L" in the aggregate, are of a dimension at least as great as the dimension "L", and in the embodiment of FIG. 2, are even greater than that dimension "L". The above relationship can be expressed in a formula, such that the aggregate length of the individual zones in a portion of the band relative to the length of the portion of the band is defined as:

$$\Sigma X \leqq L$$

where $\Sigma X$ = the aggregate length or sum of the individual lengths of the adhesive zones, each being measured horizontally from their horizontal left-most point to their horizontal right-most point; and where L = the length of the portion of the band of the adhesive zones from the left-most end of a left-most zone in a said band portion to the right end of a right-most zone of said band portion. Thus, along a given band portion such as that designated by the letter "L", there is no location therealong, at which an imaginary line crossing through the band perpendicular to the horizontal band 108, in the plane of the adhesive zones 111, at which such imaginary perpendicular line 121 would not intersect an adhesive zone 111. As can be seen with reference to the adhesive zones 117 in band 112, the same condition is existant. It will also be noted that a strip of release paper or film 109 is present in overlying relation to the adhesive zones 111 of band 108, and that such a strip, if desired, could overly the upper surface of the shingle 101, in the vicinity of the band 112, to likewise protect the adhesive zones 117 during packaging and shipment, but that the same release paper or film 109 would be removed prior to installation of the shingle 101, as is conventional. It will also be understood that, while two bands 108, 112 of adhesive zones 111, 117, are disclosed in the embodiment of FIG. 2, it will be commonplace, and in many instances preferable, that only one such band of adhesive zones is utilized, either at the location of band 108, or at the location of band 112, as desired.

It will also be apparent that various details of shingle construction, such as are embodied in FIG. 1, may also be utilized with respect to FIG. 2, and that the same need not be duplicated herein.

Figure 3:
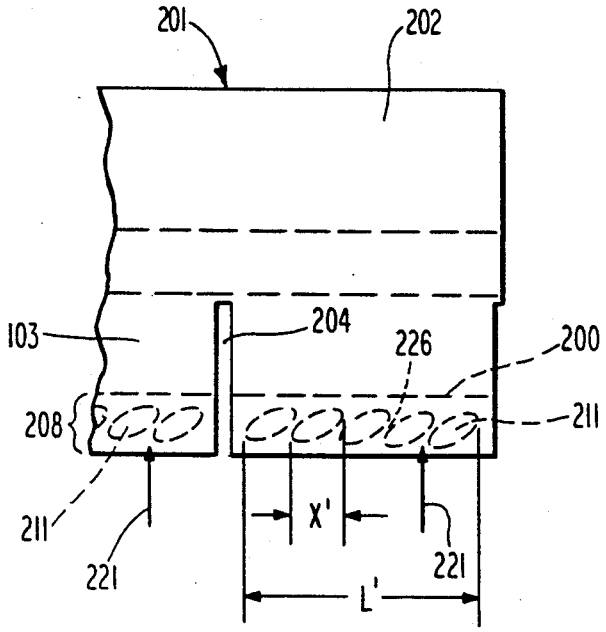

With particular reference now to FIG. 3, it will be seen that another embodiment of a shingle 201 is disclosed, having a butt portion 202 and tab portions 203. The tab portions 203 are separated by slots 204, as set forth above. It will also be understood that beneath an imaginary line 200 in the tab portions 203, there is provided a band 208 of a plurality of adhesive zones 211. The adhesive zones 211 likewise represent an alternative arrangement in which the aggregate dimension defined by the length "X'" for the plurality of adhesive zones 211 within the band portion "L'" are at least as great as, and preferably greater than the dimension "L'" between one end of one zone to the opposite end of another zone in the same band portion when measured horizontally, such that there is no location along that band portion at which an imaginary line 221 could cross through the band in a direction perpendicular to the horizontal band and in the plane of the adhesive zones without intersecting an adhesive zone 211.

With respect to the embodiments of FIGS. 1 and 2, it will be seen that the spaces 26, 115 and 126 between adjacent adhesive zones are non-perpendicular to the horizontal band, and comprise a plurality of parallel sloped openings through the band. With respect to the embodiment of FIG. 3, such openings 226 are generally sloped, given the elliptical configurations of the zones 211. It will be understood that such openings 26, 115, 126, 226, allow for escape of moisture from between overlying shingles of the type illustrated in FIG. 5 , rather than being trapped above the sealing zones indicated. Successive courses of shingles are thus able to breathe, but without allowing any substantial direct invasion of air, wind or the like in a direction perpendicular to the bands 8, 108, 112, 208, etc., and with respect to the embodiments of FIGS. 2 and 3, without allowing any space for direct invasion of the bands 108, 208, by wind or the like, in a direction perpendicular to that of the horizontal bands; namely, in a direction such as that indicated by the arrows 121 or 221.

Figure 4:
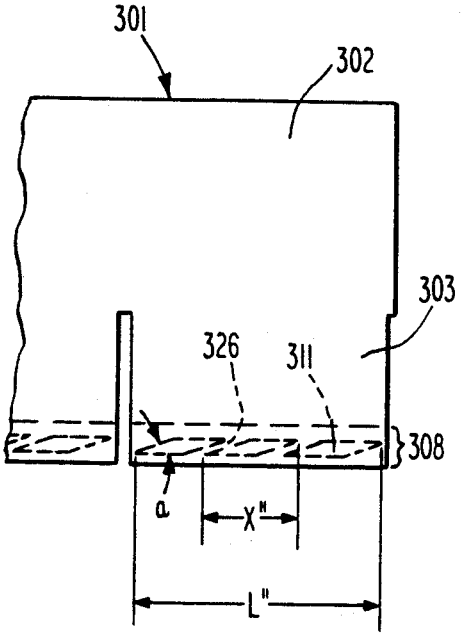
FIGS. 3 and 4 are enlarged fragmentary plan views of other alternative shingle constructions.

With reference now to the embodiment of FIG. 4, it will be seen that another alternative shingle design 301 is provided, with butt and tab portions 302, 303, respectively, with a band zone 308 for application of adhesive zones 311 thereto, at the lower end of the tab portions 303. The application of adhesive to the band portion 308 in FIG. 4, is like that in band portion 08 of FIG. 2, except that the acute angles in the parallelogram configurations of adhesive zones 311 on the under side of the tab portions 303 of shingle 301 are significantly more acute than with respect to comparable acute angle portions of the parallelogram configurations 111 of FIG. 2. In some respects, the arrangement of FIG. 4 provides a more preferred embodiment, in that it allows for an even more acutely sloped spacing 326 between adjacent adhesive zones 311 than in FIG. 2, and additionally allows for an aggregate length of the individual zones "X'" in FIG. 4 being even greater than the length "L'" measured horizontally from one end of one zone to an opposite end of another zone in a band portion. Typical of such an acute angle "a" might be 17°, as for example, where the height of the parallelogram is a unit of approximately one, and the length of a base line is a unit of approximately three. It will be understood that the illustration of FIG. 4 is not to scale, but is intended to be representative, only. It will likewise be apparent that various other angular relationships may be used, more greatly or in lesser amounts, acute, and even that other configurations other than parallelogram configurations may be used for the adhesive application.

With reference to FIG. 5, it will be seen that there is illustrated a roof deck comprising a shingled roof of a plurality of shingles of the type discussed above. In FIG. 4 it will be seen that nailing zones 24 are indicated to show how shingles are secured to a roofing surface 45. As aforesaid, the strips 109 or the like which cover the adhesive zones of an adhesive band are removed before application, to allow adhesive in adhesive zones to secure tab and butt portions of a pair of shingles in two successive courses, to adhere to each other to resist wind lift-up and the like.

It will be apparent from the foregoing that while the preferred form of the invention is recited as being that of a shingle, that roof coverings of other types other than shingles may be utilized, such as rolled roofing or the like, in which the same adhesive arrangements as are disclosed herein may be satisfactorily utilized. Furthermore, while shingles in accordance with this invention are recited as having a plurality of tab portions, in the preferred embodiment, it will be understood that a single tab portion may be utilized with a single butt portion, for a given shingle.

It will also be apparent that the precise geometric arrangement of the adhesive zones within any given band of adhesive may vary, such as taking on circular, elliptical, parallelogram, trapezoidal, triangular, configurations or the like, that such variations are within the spirit and scope of the invention as recited in the claims, and are intended to be representative only, in that such adhesive zones may take any number of configurations, provided that they allow a passage for venting of moisture, while at the same time preventing tab lift-up by access to any significant discontinuity in the adhesive zones in an adhesive band.

What is claimed is:

1. A roof covering article of a shingle type, comprising a butt portion and at least one tab portion, with a generally horizontal band comprising a plurality of adhesive zones across a lower end of any of said butt portion and said tab portion, on at least one surface thereof, the articles being adapted to be used as one of a number of such articles laid in successively partially overlying relation to other such articles, with butt portions of such articles being substantially covered by tab portions of next overlying articles, with lower ends of butt portions in sealed engagement with lower ends of tab portions, the improvement comprising said band being one adhesive zone high in a vertical direction and with adhesive zones in said band being discontinuous horizontally along said band, with the aggregate length of said individual zones in a portion of said band relative to the length of the portion of the band being defined by the formula:

$$\Sigma X \geqq L$$

where $\Sigma X$ = the aggregate length or sum of the individual lengths of the adhesive zones, each being measured horizontally from their horizontal left-most point to their horizontal right-most point; and where L = the length of the portion of the band of the adhesive zones from the left-most end of a left-most zone in a said band portion to the right end of a right-most zone of said band portion, there being no location along said portion of said band at which an imaginary line crossing through said band, perpendicular to the horizontal band and in the plane of said adhesive zones, would not intersect an adhesive zone.

2. The roof covering article of claim 1, wherein said discontinuous adhesive band comprises at least one non-adhesive opening through said adhesive band, which opening is non-perpendicular to said horizontal band.

3. The roof covering article of claim 2, wherein said discontinuous adhesive band comprises a plurality of generally parallel sloped openings through said band.

4. The roof covering article of claim 3, wherein said discontinuous adhesive band comprises a plurality of spaced apart generally parallelogram-shaped adhesive zones.

5. The roof covering article of any one of claims 1, 2, 3, and 4 wherein said band lies on the bottom surface of the tab portion of the article.

6. The roof covering article of any one of claims 1, 2, 3, and 4, wherein said band lies on the upper surface of the butt portion of the article.

7. The roof covering article of any one of claims 1, 2, 3, and 4, wherein there are a plurality of tab portions in each articles, separated by generally slot-like openings.

8. The roof covering article of any one of claims 1, 2, 3, and 4, including a strip of release paper or film covering the adhesive zones in a said band.

9. A roof system comprising a plurality of articles in accordance with any of claims 1, 2, 3, and 4, with said articles being laid in a plurality of courses, with successive courses of said articles being partially overlapped relative to butt portions of next previous courses to provide exposure of the articles of lower, tab portions of the articles in said next previous course.

* * * * *

UNITED STATES PATENT AND TRADEMARK OFFICE

CERTIFICATE OF CORRECTION

PATENT NO. : 5,239,802

DATED : August 21, 1993

INVENTOR(S) : Norman M. Robinson

It is certified that error appears in the above-indentified patent and that said Letters Patent is hereby corrected as shown below:

In Column 3, line 9 after shingle art and before Fig. 1 there should be a period (end of sentence);

In Column 3, line 48 the formula $\Sigma X \leq L$ should be $\Sigma X \geq L$;

In Column 4, line 62 after band portion 08 should be 108;

In Column 6, line 13 formula $\Sigma X \geq L$ should be $\Sigma X \geq L$.

Signed and Sealed this

Fifteenth Day of March, 1994

*Attest:*

*Attesting Officer*

Bruce Lehman

BRUCE LEHMAN

*Commissioner of Patents and Trademarks*